US011751317B2

(12) United States Patent
Akiyama et al.

(10) Patent No.: US 11,751,317 B2
(45) Date of Patent: Sep. 5, 2023

(54) X-RAY GENERATING DEVICE, AND DIAGNOSTIC DEVICE AND DIAGNOSTIC METHOD THEREFOR

(71) Applicant: Shimadzu Corporation, Kyoto (JP)

(72) Inventors: Goshi Akiyama, Kyoto (JP); Tsunehisa Ohashi, Kyoto (JP); Kenichiro Nakamura, Kyoto (JP); Yuta Saito, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 100 days.

(21) Appl. No.: 17/432,469

(22) PCT Filed: Mar. 1, 2019

(86) PCT No.: PCT/JP2019/008089

§ 371 (c)(1),
(2) Date: Aug. 19, 2021

(87) PCT Pub. No.: WO2020/178898

PCT Pub. Date: Sep. 10, 2020

(65) Prior Publication Data

US 2022/0132645 A1 Apr. 28, 2022

(51) Int. Cl.
*H05G 1/26* (2006.01)
*H05G 1/32* (2006.01)

(52) U.S. Cl.
CPC ..... *H05G 1/265* (2013.01); *H05G 1/32* (2013.01)

(58) Field of Classification Search
CPC ..... H01J 35/20; H01J 35/18; H01J 35/025; H01J 35/16; H01J 2235/20; H01J 2235/18;

(Continued)

(56) References Cited

U.S. PATENT DOCUMENTS 6,192,106 B1 * 2/2001 Miller ..... H01J 9/385 378/123
7,197,114 B2 * 3/2007 Le-Pierrard ..... H01J 35/165 378/123

(Continued)

FOREIGN PATENT DOCUMENTS

JP S55-119397 A 9/1980
JP 2006100174 A 4/2006

(Continued)

OTHER PUBLICATIONS

Extended European Search Report dated Sep. 9, 2022, for corresponding European application No. EP 19918268.4.

(Continued)

*Primary Examiner* — Irakli Kiknadze
(74) *Attorney, Agent, or Firm* — Muir Patent Law, PLLC

(57) ABSTRACT

An X-ray tube is provided with: a cathode and an anode sealed inside a vacuum envelope; and an ion-collecting conductor attached to the vacuum envelop so as to be in contact with an internal space of the vacuum envelope. A first current sensor measures a value of a first current flowing between the ion-collecting conductor and a node for supplying potential for attracting positive ions in the vacuum envelope. A second current sensor measures a value of a second current flowing between the anode and the cathode. A control circuit generates diagnostic information on the degree of vacuum of the X-ray tube based on a current ratio file of the first current value (Ii) measured by the first current sensor to the second current value (Ie) measured by the second current sensor.

5 Claims, 7 Drawing Sheets

(58) Field of Classification Search
CPC ..... H01J 35/045; H01J 35/066; H01J 35/08; H01J 35/14; H01J 35/147; H01J 35/153; H01J 35/116; H01J 2235/082; H01J 2235/1225; H01J 2235/1204; H01J 35/30; H05G 1/265; H05G 1/54; H05G 1/32; H05G 1/30; H05G 1/085; H05G 1/46; H05G 1/52; H05G 1/10; H05G 1/34; H05G 1/36; G01N 23/04; G01N 23/083; G01N 2223/04; G01N 2223/204; G01T 1/16
USPC ..... 378/109–118, 119, 123, 140
See application file for complete search history.

(56) References Cited

U.S. PATENT DOCUMENTS 7,639,784 B2 * 12/2009 Feda ..... G01N 23/223 378/118
2012/0027177 A1 * 2/2012 Ogata ..... H01J 35/065 378/95
2012/0082299 A1 * 4/2012 Tang ..... H01J 35/064 378/123
2014/0140474 A1 * 5/2014 Caruso ..... G01N 23/02 378/53
2021/0092823 A1 3/2021 Koba et al.

FOREIGN PATENT DOCUMENTS

JP 2016146288 A 8/2016
JP 2019-106342 A 6/2019

OTHER PUBLICATIONS

Notice of Reasons for Refusal for Japanese patent application No. JP 2021-503253, dated Jul. 5, 2022.
Written Opinion of the International Searching Authority for PCT Application No. PCT/JP2019/008089, dated May 28, 2019, submitted with a machine translation.
Office Action for corresponding Japanese Patent Application No. 2021-503253 dated Dec. 20, 2022.

* cited by examiner

X-RAY GENERATING DEVICE, AND DIAGNOSTIC DEVICE AND DIAGNOSTIC METHOD THEREFOR

TECHNICAL FIELD

The present invention relates to an X-ray generating device, and a diagnostic device and a diagnostic method therefor.

BACKGROUND OF THE INVENTION

An X-ray generating device is widely applied to analyzers, medical instruments, and the like. Generally, an X-ray generating device is configured to generate X-rays in a vacuum-sealed X-ray tube by accelerating electrons emitted from a cathode by a high voltage applied between an anode and the cathode to collide the electrons against a target formed on the surface of the anode.

When the degree of vacuum in the X-ray tube deteriorates due to aging, i.e., when the pressure rises, the replacement of the X-ray tube is required due to the generation of discharge. Therefore, a technique to predict the life of an X-ray tube by detecting the deterioration of the degree of vacuum in a non-destructive manner has been proposed. This technique is described in Japanese Unexamined Patent Application Publication No. 2006-100174 (Patent Document 1) and Japanese Unexamined Patent Application Publication No. 2016-146288 (Patent Document 2).

Patent Document 1 discloses a configuration in which a vacuum measuring unit with a built-in ion gauge sphere for an ionization vacuum gauge is attached to a vacuum envelope of an X-ray tube to measure the degree of vacuum inside the vacuum envelope.

Patent Document 2 discloses a technique for measuring the degree of vacuum of an X-ray tube. This technique utilizes the correlation between a measurement current and the degree of vacuum based on the measured current flowing between an anode and a cathode when gas molecules to be ionized in the X-ray tube is attracted to the anode with the electric field between the anode and the cathode opposite to the direction at which X-rays are generated.

PRIOR ART DOCUMENT

Patent Document

Patent Document 1: Japanese Unexamined Patent Application Publication No. 2006-100174

Patent Document 2: Japanese Unexamined Patent Application Publication No. 2016-146288

SUMMARY OF THE INVENTION

Problems to be Solved by the Invention

However, in the configuration of Patent Document 1, since the vacuum measuring unit is attached to the vacuum envelope, there are concerns about the deterioration of the degree of vacuum from the attachment point and increased costs due to the addition of the new structure. On the other hand, in the configuration of Patent Document 2, there is no need to change the configuration of the X-ray tube including the vacuum envelope. However, when measuring the degree of vacuum, a mechanism is newly required to apply a voltage between the collecting element and the filament (electron source), and a mechanism for generating an electric field between the anode and the cathode in the direction opposite to that when the X-rays are generated is also newly required.

In the configuration of Patent Document 2, a current corresponding to the amount of ions generated by the collision of electrons emitted from the cathode against gas molecules is measured in the same manner as an ionization vacuum meter to quantitively measure the gas molecules. For this reason, the measured current varies depending not only on the amount of gas molecules present in the X-ray tube but also on the electron emission amount. On the other hand, in the configuration of Patent Document 2, the life of the X-ray tube is predicted from the previously determined correlation between the measured current and the degree of vacuum. Therefore, due to the aging of the device, the fluctuation of the power supply voltage, the individual difference in the X-ray tube, and the like, the following concerns arise. When the amount of electrons emitted from the cathode at the time of measuring the degree of vacuum differs from the electron emission amount at the time of determining the above-described correlation, there is a concern that errors may occur in the measurement of the degree of vacuum, that is, in the life diagnosis of the X-ray tube.

The present invention has been made to solve the above-described problems. It is an object of the present invention to perform deterioration diagnosis of an X-ray tube with high accuracy by a simple configuration.

Means for Solving the Problem

A first aspect of the present invention related to an X-ray generating device. The X-ray generating device is provided with an X-ray tube, first and second DC current power supplies, first and second current sensors, and a control circuit. The X-ray tube includes a cathode and an anode which are sealed inside a vacuum envelope, and an ion-collecting conductor attached to the vacuum envelope so as to be in contact with an internal space of the vacuum envelope. The cathode includes an electron source for emitting electrons. The anode is arranged to face the cathode and configured to emit X-rays when electrons emitted from the electron source are incident. The first DC power supply is configured to apply a first DC voltage for supplying emission energy of electrons to the electron source. The second DC power supply is configured to apply a second DC voltage for generating an electric field for making the anode to be high potential between the cathode and the anode. The first current sensor is configured to measure a value of a first current flowing between the ion-collecting conductor and a node for supplying potential for attracting positive ions in the vacuum envelope. The second current sensor is configured to measure a value of a second current flowing between the anode and the cathode. The control circuit is configured to generate diagnostic information on a degree of vacuum of the X-ray tube based on a current ratio of the value of the first current measured by the first current sensor to the value of the second current measured by the second current sensor in a state in which the first DC voltage and the second DC voltage are being applied.

A second aspect of the present invention relates to a diagnostic device for an X-ray generating device equipped with an X-ray tube including an anode and a cathode provided with an electron source, the anode and the cathode being sealed inside a vacuum envelope, and an ion-collecting conductor attached to the vacuum envelope so as to be in contact with an internal space of the vacuum envelope. The diagnostic device is provided with a current sensor and a control circuit. The current sensor is configured to measure a value of a first current flowing between the ion-collecting conductor and a node for applying potential for attracting positive ions in the vacuum envelope. The control circuit is configured to:

acquire, in the X-ray generating device, in a state in which a first DC voltage for supplying emission energy of electrons is applied to the electron source, and a second DC voltage for generating an electric field for making the anode to be high potential is applied between the cathode and the anode, a measurement value of the value of the second current flowing between the anode and the cathode of the X-ray tube from the X-ray generating device; and generate diagnostic information on a degree of vacuum of the X-ray tube based on a current ratio of the value of the first current measured by the current sensor to the acquired value of the second current.

A third aspect of the present invention relates to a diagnostic method for an X-ray generating device. The X-ray generating device includes an X-ray tube including an anode and a cathode provided with an electron source, the anode and the cathode being sealed inside a vacuum envelope, and an ion-collecting conductor attached to the vacuum envelope so as to be in contact with an internal space of the vacuum envelope. The diagnostic method includes the steps of:

applying a first DC voltage for supplying emission energy of electrons to the electron source and applying a second DC voltage for generating an electric field to make the anode to be high potential between the cathode and the anode;

measuring a value of a first current flowing between the ion-collecting conductor and a node for applying potential for attracting positive ions in the vacuum envelope in a state in which the first DC voltage and the second DC voltage are being applied;

measuring a value of a second current flowing between the anode and the cathode of the X-ray tube in a state in which the first DC voltage and the second DC voltage are being applied; and generating diagnostic information on a degree of vacuum of the X-ray tube based on a current ratio of the value of the first current measured by the current sensor to the acquired value of the second current.

Effects of the Invention

According to the present invention, it is possible to perform a deterioration diagnosis of an X-ray tube with high accuracy by a simple configuration.

EMBODIMENTS FOR CARRYING OUT THE INVENTION

Figure 1:
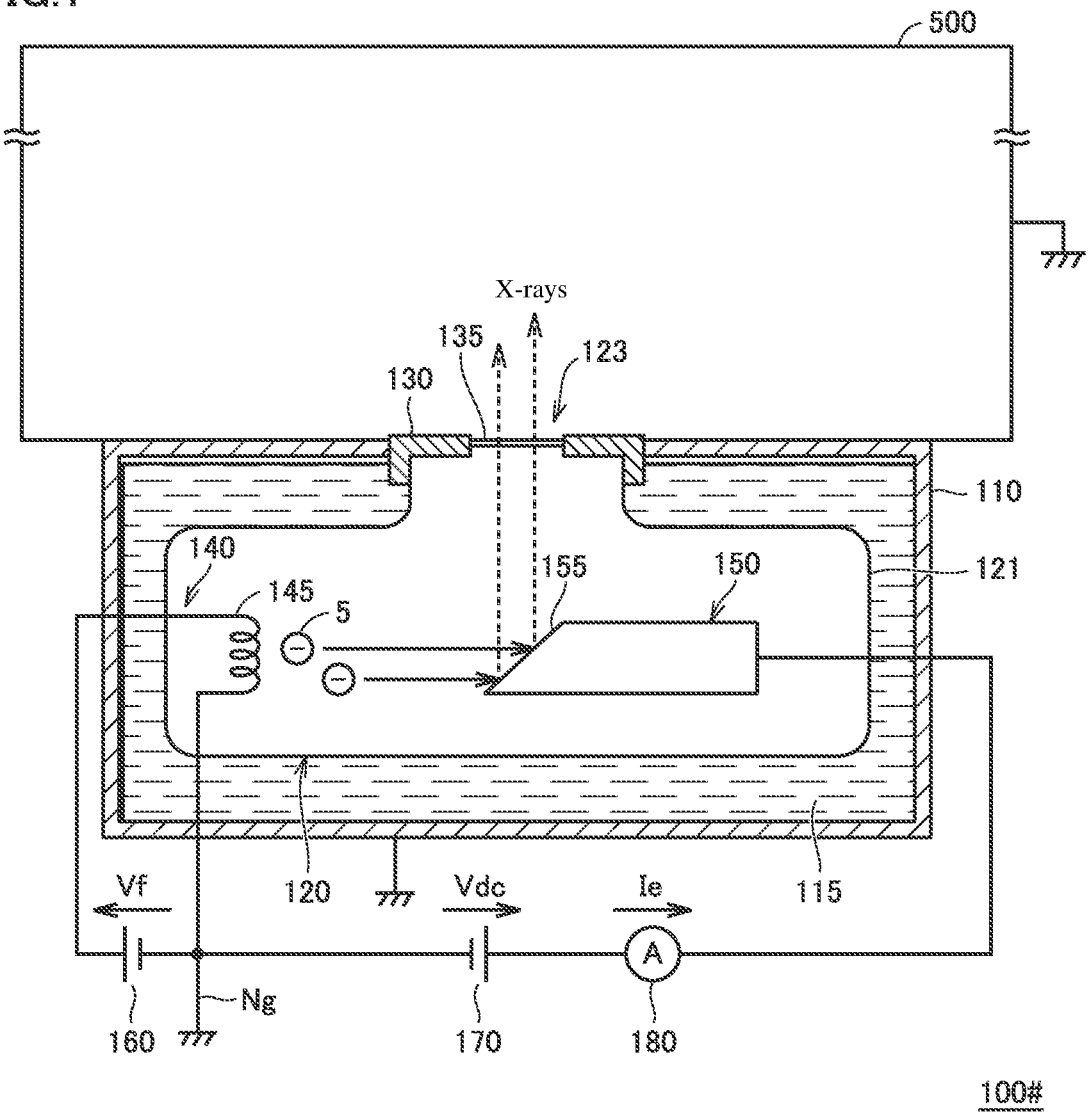
FIG. 1 is a block diagram for explaining a configuration of a typical X-ray generating device shown as Comparative Example.

Hereinafter, some embodiments of the present invention will be described in detail with reference to the attached drawings. In the following description, the same or corresponding component in the drawings is denoted by the same reference numeral, and the description thereof will not be repeated as a general rule.

FIG. 1 is a block diagram for explaining a configuration of a typical X-ray generating device shown as Comparative Example.

Referring to FIG. 1, the X-ray generating device 100# as Comparative Example is provided with a housing 110, an X-ray tube 120, and a DC power supplies 160 and 170. The inside of the X-ray tube 120 is held in vacuum by being sealed by a vacuum envelope 121.

The X-ray tube 120 has a cathode 140 and an anode 150 sealed inside the vacuum envelope 121. A filament 145 is attached to the surface of the cathode 140. A target 155 is formed at a position of the anode 150 facing the filament 145.

The DC power supply 160 is connected to the filament 145. The output voltage Vf of the DC power supply 160 is generally about 10 V. By energizing the filament 145 by the DC power supply 160, the thermally excited electrons 5 are emitted from the filament 145. That is, by the output voltage Vf of the DC power supply 160, the emission energy of the electrons 5 is supplied to the filament 145.

The output voltage Vdc of the DC power supply 170 is generally tens kV to hundreds kV. A high voltage is applied between the cathode 140 and the anode 150 by the DC power supply 170. With this, between the cathode 140 and the anode 150, the electric field in which the anode 150 side is high in potential is formed. The anode 150 generates X-rays when the electrons 5 emitted from the filament 145 are accelerated by the electric field and collide against the target 155.

The X-rays are output to the outside of the X-ray tube 120 via an X-ray irradiation window 135 provided at the opening 123 of the vacuum envelope 121. The X-ray irradiation window 135 is formed using a material having airtightness and high X-ray transmittance (for example, a film-like beryllium). The X-ray irradiation window 135 is fixed to the X-ray tube 120 (vacuum envelope 121) via a flange-shaped fixing member 130. The fixing member 130 is configured to have a contact region contacting the internal space of the vacuum envelope 121 and maintain the sealability by the vacuum envelope 121 to fixedly hold the X-ray irradiation window 135 to the vacuum envelope 121. Further, the fixing member 130 and the housing 110 are electrically connected.

To the fixing member 130, an external device 500 as an X-ray supply target is attached by screwing or the like. The external device 500 is typically an analytical or medical instrument. Normally, the external device 500 is attached and fixed to the fixing member 130, so that the housing 110 and the fixing member 130 are grounded by a common ground common to the external device 500.

The X-ray tube 120 is stored inside the housing 110 filled with insulation oil 115. The insulation oil 115 electrically insulates the X-ray tube 120 to which a high voltage is applied, from the housing 110 and also has a cooling function of the X-ray tube 120.

When the output voltages Vf and Vdc of the DC power supplies 160 and 170 are applied to the X-ray tube 120, X-rays are output through the X-ray irradiation window 135 of the X-ray tube 120. The irradiation quantity of the X-rays varies depending on the output voltages of the DC power supplies 160 and 170. Specifically, depending on the output voltage Vf of the DC power supply 160, the quantity of electrons to be emitted from the filament 145 changes, and the X-ray irradiation quantity changes. By arranging a current sensor 180 between the cathode 140 or the anode 150 and the DC power supply 170, a value of a current Ie (hereinafter also referred to as an "emitter current Ie") depending on the quantity of electrons can be detected. It is also possible to change X-ray irradiation quantity by changing the output voltage Vdc of the DC power supply 170 to change the intensity of the electric field to accelerate electrons 5.

In this embodiment, a configuration having a function of non-destructively diagnosing the degree of vacuum of the internal space of the X-ray tube 120 will be described with respect to the X-ray generating device 100 # of Comparative Example shown in FIG. 1.

Figure 2:
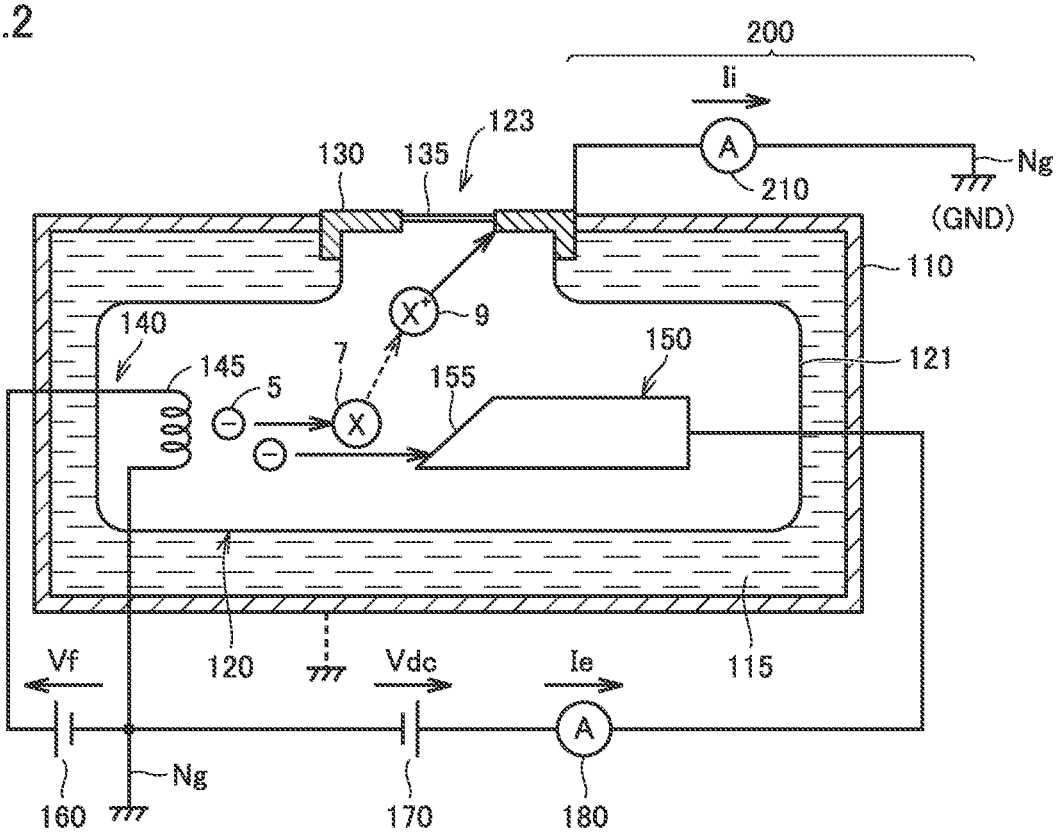
FIG. 2 is a block diagram for explaining a configuration of an X-ray generating device according to an embodiment of the present invention.
Figure 2:
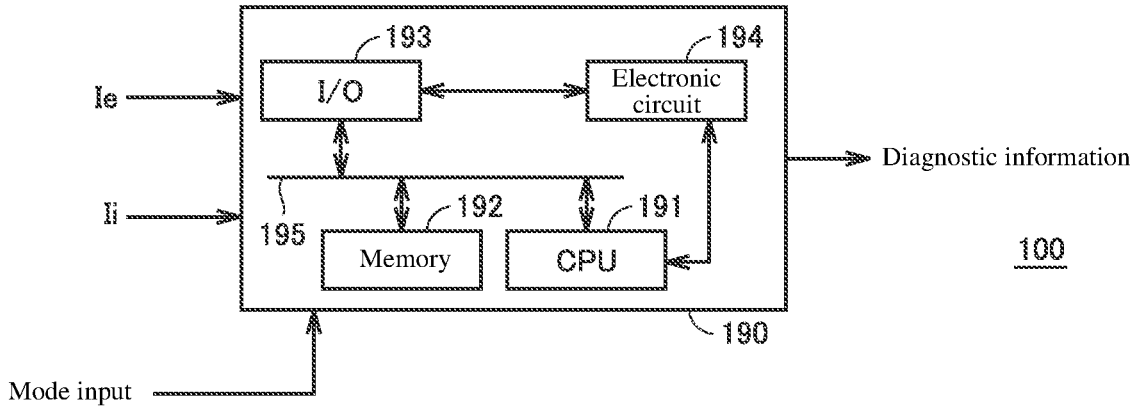

FIG. 2 is a block diagram for explaining the configuration of the X-ray generating device according to this embodiment. Referring to FIG. 2, the X-ray generating device 100 according to this embodiment differs in that it is further provided with a control circuit 190 and a current sensor 210, as compared with the X-ray generating device 100# of Comparative Example shown in FIG. 1.

The current sensor 210 is electrically connected between the fixing member 130 and the ground node Ng. Note that since the fixing member 130 and the housing 110 are electrically connected, even by connecting the current sensor 210 to the housing 110, it is possible to electrically connect the current sensor 210 between the fixing member 130 and the ground node Ng. As described below, the current sensor 210 detects the current value Ii in a diagnostic mode.

The control circuit 190 includes a CPU (Central Processing Unit) 191, a memory 192, an input/output I/O circuit 193, and an electronic circuit 194. The CPU 191, the memory 192, and the I/O circuit 193 can exchange signals with each other via the bus 195. The electronic circuit 194 is configured to execute predetermined operation processing by dedicated hardware. The electronic circuit 194 can exchange signals between the CPU 191 and the I/O circuit 193.

The control circuit 190 receives mode inputs and the detection values of the currents Ie and Ii detected by the current sensors 180 and 210 and outputs diagnostic information indicating the diagnostic result of the degree of vacuum in a diagnostic mode. The control circuit 190 may typically be configured by a microcomputer. Note that in the following description, processing in the diagnostic mode by the control circuit 190 will be mainly described. It should be, however, noted that the configuration example shown in FIG. 2 does not mean that the arrangement of a microcomputer dedicated to the diagnostic mode is essential. For example, in the X-ray generating device 100 # of Comparative Example, the control circuit 190 can be configured by adding a diagnostic mode function (to be described later) to a microcomputer (not shown) arranged for controlling X-ray generation. Therefore, the X-ray generating device 100 according to this embodiment can be realized only by additionally arranging the current sensor 210 on hardware with respect to the X-ray generating device 100 # of Comparative Example.

The X-ray generating device 100 has an X-ray generation mode for emitting X-rays and a diagnostic mode. The X-ray generation mode and the diagnostic mode can be selected by a mode input to the control circuit 190 responsive to a button operation, etc., by the user.

The operation of the X-ray generating device 100 in the X-ray generation mode is the same as that of the X-ray generating device 100 of FIG. 1, so the detailed description is not repeated. Furthermore, in the X-ray generating device 100, even in the diagnostic mode, the connecting relation of the DC power supply 160 to the cathode 140 is the same as that in the X-ray generation mode. Similarly, the output voltage Vdc of the DC power supply 170 is applied between the cathode 140 and the anode 150 with the same polarity as in the X-ray generation mode. That is, the DC power supply 160 corresponds to one example of the "first DC power supply", and the output voltage Vf corresponds to one example of the "first DC voltage". Similarly, the DC power supply 170 corresponds to one example of the "second DC power supply", and the output voltage Vdc corresponds to one example of the "second DC voltage".

The degree of vacuum of the X-ray tube 120 deteriorates in accordance with the increase of gas molecules 7 present in the internal space of the X-ray tube 120 due to the occluded gases coming out of the components of the X-ray tube 120, gases generated by the heat generated by electron collisions, or the like. The gas molecule 7 changes to a positive ion 9 when ionized due to collision against the electron 5.

The fixing member 130 is electrically connected to the ground node Ng for supplying the ground potential GND by the path 200 including the current sensor 210. Therefore, the positive ion 9 generated in the internal space of the X-ray tube 120 is attracted to the fixing member 130. As a result, a current Ii (hereinafter also referred to as an "ion current Ii") that depends on the amount of positive ions generated in the internal space of the vacuum envelope 121 is generated in the path 200. The ion current Ii can be measured by the current sensor 210. At the same time, the current sensor 180 can measure the emitter current Ie that depends on the electron emission from the filament 145, in the same manner as when X-rays are generated. The value of the emitter current Ie corresponds to the "second current value", and the current sensor 180 corresponds to one example of the "value of the second current". Further, the value of the ion current Ii corresponds to the "value of the first current", and the current sensor 210 corresponds to one example of the "first current sensor" or the "current sensor".

Further, in the configuration of FIG. 2, as in FIG. 1, when the fixing member 130 or the housing 110 is grounded through a path not including the current sensor 210 by an external device 500 or the like, both ends of the current sensor 210 becomes the same potential. For this reason, it becomes impossible to measure the ion current Ii by the current sensor 210. Therefore, the external device 500 is detached from the fixing member 130 so that the fixing member 130 and the housing 110 are grounded though the path 200 including the current sensor 210. With this, it becomes possible to detect the ion current Ii by the current sensor 210. Further, after the removal of the external device 500, a member for shielding X-rays is mounted to the X-ray irradiation window 135.

That is, in FIG. 2, the fixing member 130 corresponds to one example of the "ion-collecting conductor", and the ground node Ng corresponds to one example of the "node for applying the potential for attracting a positive ion". With this, the "ion-collecting conductor" for diagnosing the degree of vacuum can be configured without adding a new member (hardware) to the X-ray generating device 100 # of Comparative Example. If it is potential capable of attracting the positive ion 9, the current sensor 210 may be electrically connected between a node for applying the potential other than a ground potential GND and the fixing member 130.

Usually, the degree of vacuum of a closed space is quantitatively evaluated by the inner pressure of the space. Particularly, in an X-ray generating device, the generation of discharges due to the deterioration of the degree of vacuum inside the X-ray tube 120 becomes a point of the deterioration diagnostic. It is essential to diagnose the deterioration of the degree of vacuum in a non-destructive manner before the degree of vacuum deteriorates (the pressure increases) to such a level.

Figure 3:
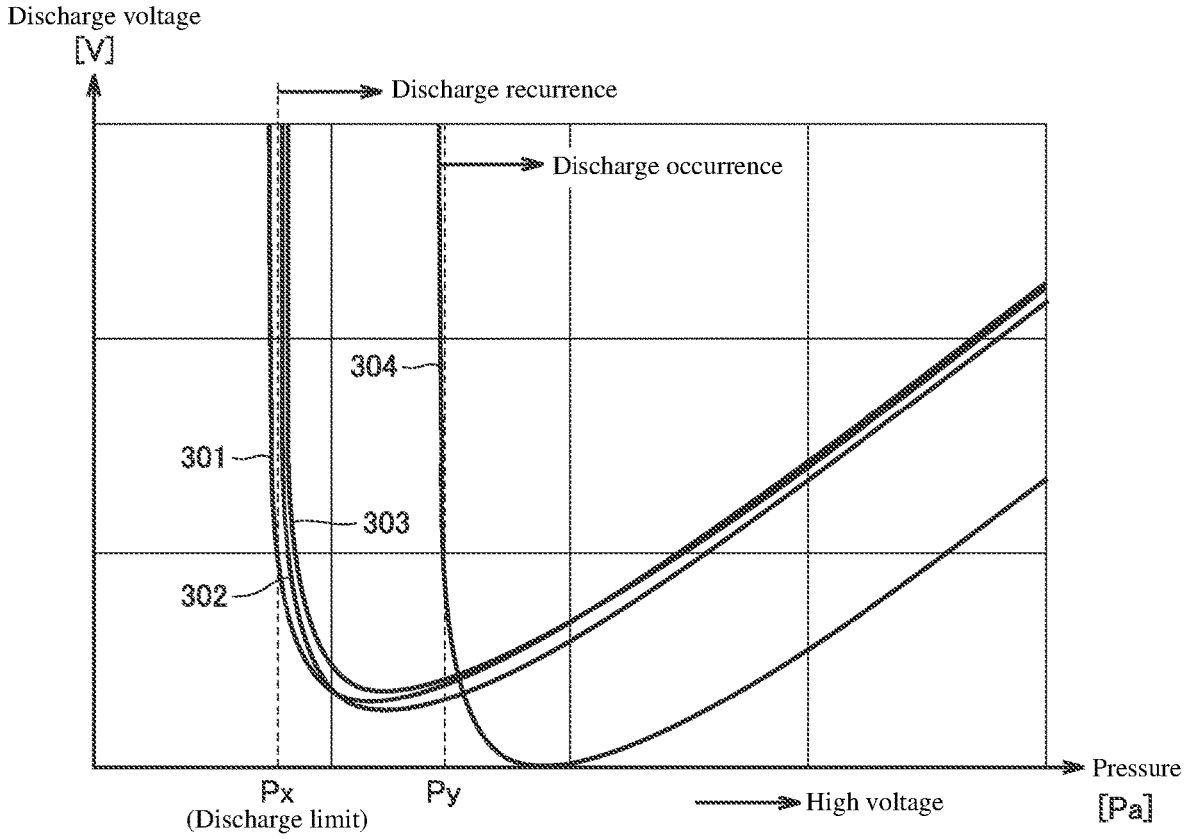
FIG. 3 is a logarithmic graph showing an example of a Paschen curve.

FIG. 3 shows an example of a Paschen curve showing discharging characteristics. The horizontal axis in FIG. 3 represents a pressure (Pa), and the vertical axis represents a discharge voltage (V). Note that in FIG. 3, both the vertical axis and the horizontal axis are logarithmic scales, and the pressure and the discharge voltage increase 10 times for each grating in the drawing.

As is known, a Paschen curve can be obtained from a Passion's law, which shows the relation between the discharge voltage, the degree of vacuum, the interelectrode distance, and the constant for each gas type. As will be described later, in order to verify the diagnosis of the degree of vacuum according to this embodiment, the inventors of the present invention conducted a measurement experiment for actually targeting X-ray tubes including a deteriorated product in which discharges actually occurred. FIG. 3 shows Paschen curves 301 to 304 for four types of gases (helium, nitrogen, water vapor, and atmosphere) obtained by analyzing the actual interior gas of an X-ray tube targeted for the measurement experiment.

Referring to FIG. 3, it is understood from the Paschen curves 301 to 304 that discharges occur at different voltages depending on the type of the gas. From the Paschen curves 301 to 303, it is understood that discharges occur in the region in which the pressure is Px (hereinafter, also referred to as "discharge pressure Px") or higher. From the Paschen curve 304, it is understood that discharges occur in the region in which the pressure is Py or higher. Therefore, for the diagnosis of the degree of vacuum for these X-ray tubes, information for quantitatively evaluating the margin for the discharge pressure Px is required in a range lower than the discharge pressure Px.

Figure 4:
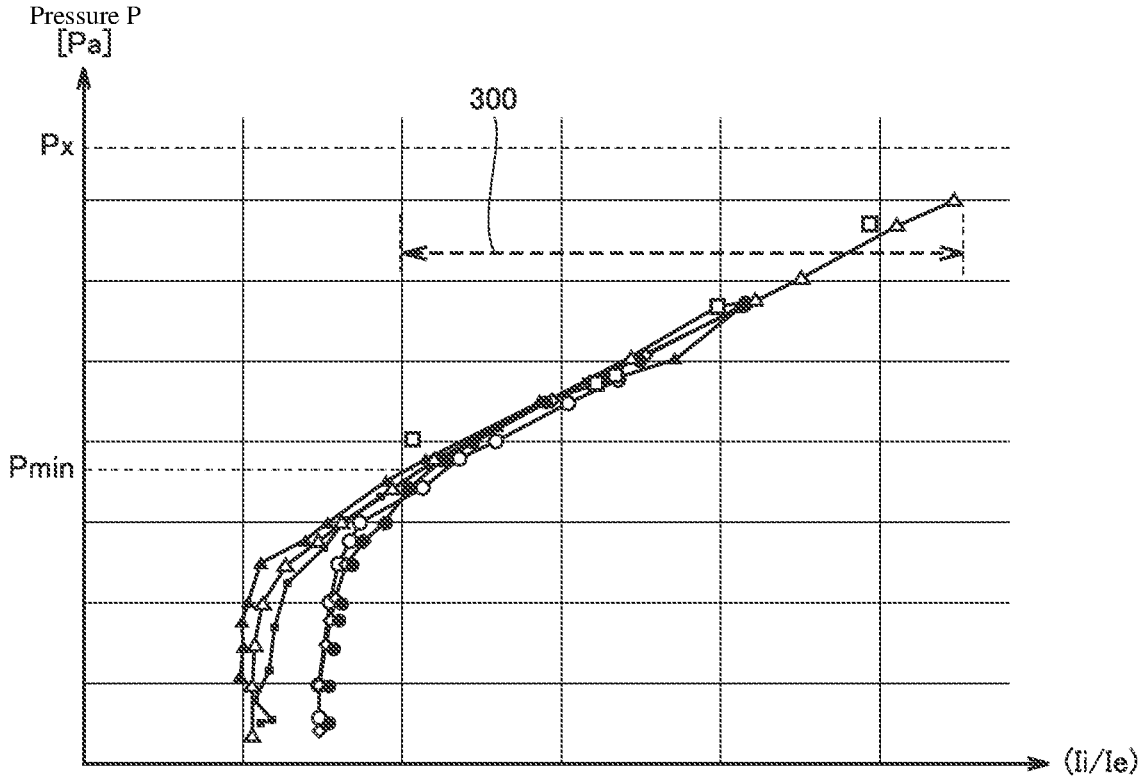
FIG. 4 is a scatter diagram showing measurement data of an X-ray tube by the diagnosis of the degree of vacuum by an X-ray generating device 100 according to this embodiment.

FIG. 4 shows measurement data of an X-ray tube by the diagnosis of the degree of vacuum by the X-ray generating device 100 according to this embodiment. In FIG. 4, experimental results are shown in which the ion current Ii and the emitter current Ie described above were measured by changing the pressure in a vacuum chamber in a state in which an opened X-ray tube as a measurement target for a gas analysis was installed in the vacuum chamber.

In the horizontal axis of FIG. 4, the current ratio Ii/Ie of the measured emitter current Ii to the measured ion current Ie is shown with a logarithmic axis. In the vertical axis, the measurement value of the pressure P(Pa) in the vacuum chamber is shown with a logarithmic axis. Experiments were performed using a plurality of X-ray tubes of the same model as measurement targets. In FIG. 4, the combination of actual measurement values of the current ratio Ii/Ie and the pressure P are plotted with different symbols for each X-ray tube.

From FIG. 4, it can be understood that in a region in which the current ratio Ii/Ie is small, the value of the current ratio Ii/Ie for the same pressure value varies from the individual X-ray tube to the individual X-ray tube. On the other hand, as the current ratio Ii/Ie rises, it is understood that there is a region 300 in which individual differences are resolved and the current ratio Ii/Ie for the same pressure value becomes approximately equal. In the region 300, the slope of the change of the pressure P to the change of the current ratio Ii/Ie on the logarithmic graph Ii/Ie is substantially constant.

Hereinafter, the region 300 in which the characteristics of P to the current ratio Ii/Ie are plotted on substantially the same straight line on the logarithmic graph regardless of the individual differences of X-ray tubes is also referred to as a "diagnostic region 300". In the diagnostic region 300, it is understood that the current ratio Ii/Ie can be used to quantitatively estimate the interior pressure of the X-ray tube 120 regardless of the individual differences in the X-ray tubes. The lower limit Pmin of the pressure range covered by the diagnostic region 300 is on the order of $1\times10^4$ times the discharge pressure Px shown in FIG. 3.

Therefore, according to this embodiment, it is understood that an increase in pressure toward the discharge pressure Px, i.e., deterioration of the degree of vacuum, can be diagnosed in a non-destructive manner at a pressure range of $Px\cdot(1/10^4)$ or more based on the current ratio Ii/Ie.

Figure 5:
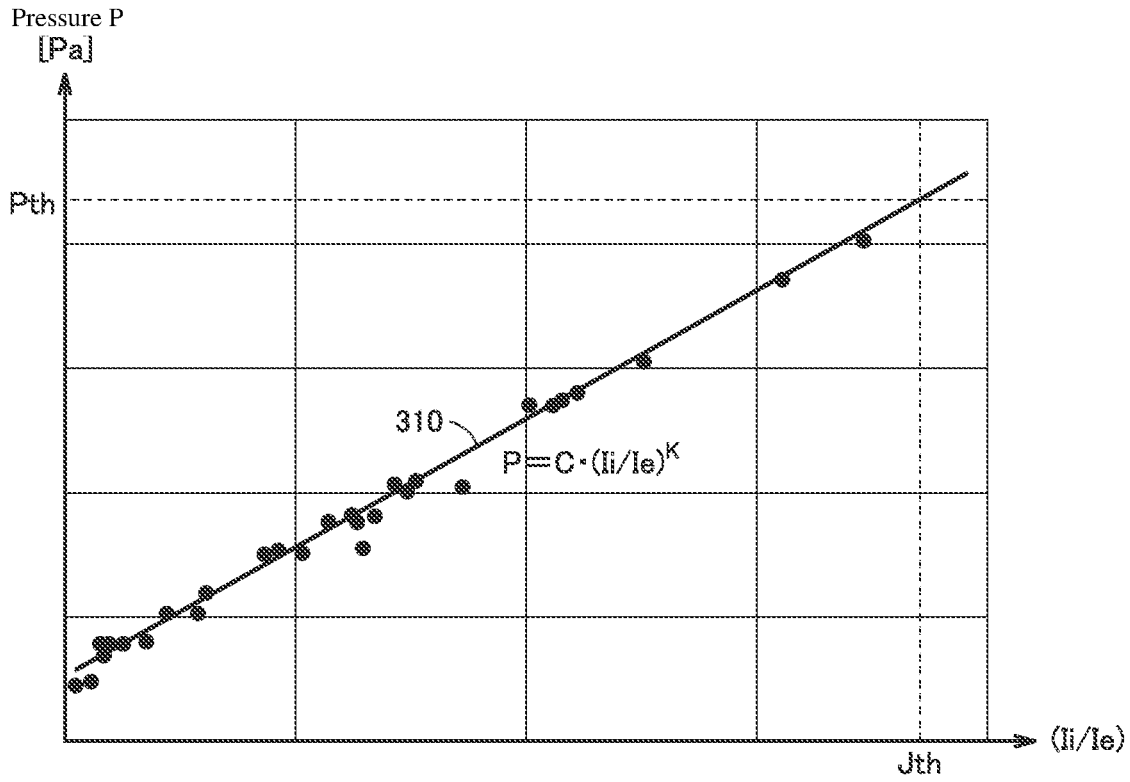
FIG. 5 is an enlarged view of a partial region of the diagram of FIG. 4.

FIG. 5 shows an enlarged view of the diagnostic region 300 of the scatter diagram of FIG. 4. In FIG. 5, the measurement data at the plurality of X-ray tubes shown in FIG. 4 is plotted with the same symbols, and the characteristic line 310 obtained as a regression line by statistical processing is also shown. That is, in the diagnostic region 300, the pressure P(Pa) proportional to the $k^{th}$ power of the current ratio Ii/Ie can be estimated by the following Expression (1) indicating the characteristic line 310.

$$P=C\cdot(Ii/Ie)k \quad (1)$$

Note that the constants C and k in Expression (1) are fixed values for each model of X-ray tubes 120 and can be handled as the same value in an X-ray tube of the same model. Therefore, the constants C and k can be predetermined by performing measurement experiments in advance for the model of the X-ray tube 120 mounted in the X-ray generating device 100. That is, the characteristic line 310 or Expression (1) corresponds to one example of the "predetermined correspondence relation between the current ratio and the pressure in the vacuum envelope 121". The information indicating the characteristic line 310 or the information indicating Expression (1) is stored in advance in the memory 192.

The control circuit 190 can calculate the pressure estimation value inside the X-ray tube 120 (vacuum envelope 121). This computation is performed using the information indicating the characteristic line 310 or Expression (1), which is stored in advance in the memory 192, and the current ratio Ii/Ie calculated from the measurement values by the current sensors 180 and 210.

For example, diagnostic information on the degree of vacuum indicating whether or not P>Px can be acquired by predetermining a threshold Pth lower than the discharge pressure Px with respect to the pressure estimation value P calculated as described above.

Note that the threshold Pth may be set to multiple levels to generate the diagnostic information on the degree of vacuum so that the deterioration degree (the degree of increase in pressure) of the degree of vacuum is indicated at multiple levels. Alternatively, the pressure difference between the pressure estimation value P and the threshold Pth or the discharge pressure Px can be calculated as the diagnostic information on the quantitative degree of vacuum. The user convenience can be improved by providing diagnostic information capable of easily imagining the deterioration of the degree of vacuum by converting the deterioration into the pressure which is a physical quantity directly related to the discharge occurrence in the X-ray tube 120.

Further, according to the characteristic line 310, it is possible to determine the threshold Jth of the current ratio Ii/Ie in advance in correspondence with the above-described threshold Pth of the pressure. This makes it possible to generate diagnostic information on the degree of vacuum based on the comparison between single or multi-stage thresholds Jth and the measurement value of the current ratio Ii/Ie. Alternatively, the difference between measurement value of the current ratio Ii/Ie and the threshold Jth can be calculated as the diagnostic information on the quantitative degree of vacuum.

Figure 6:
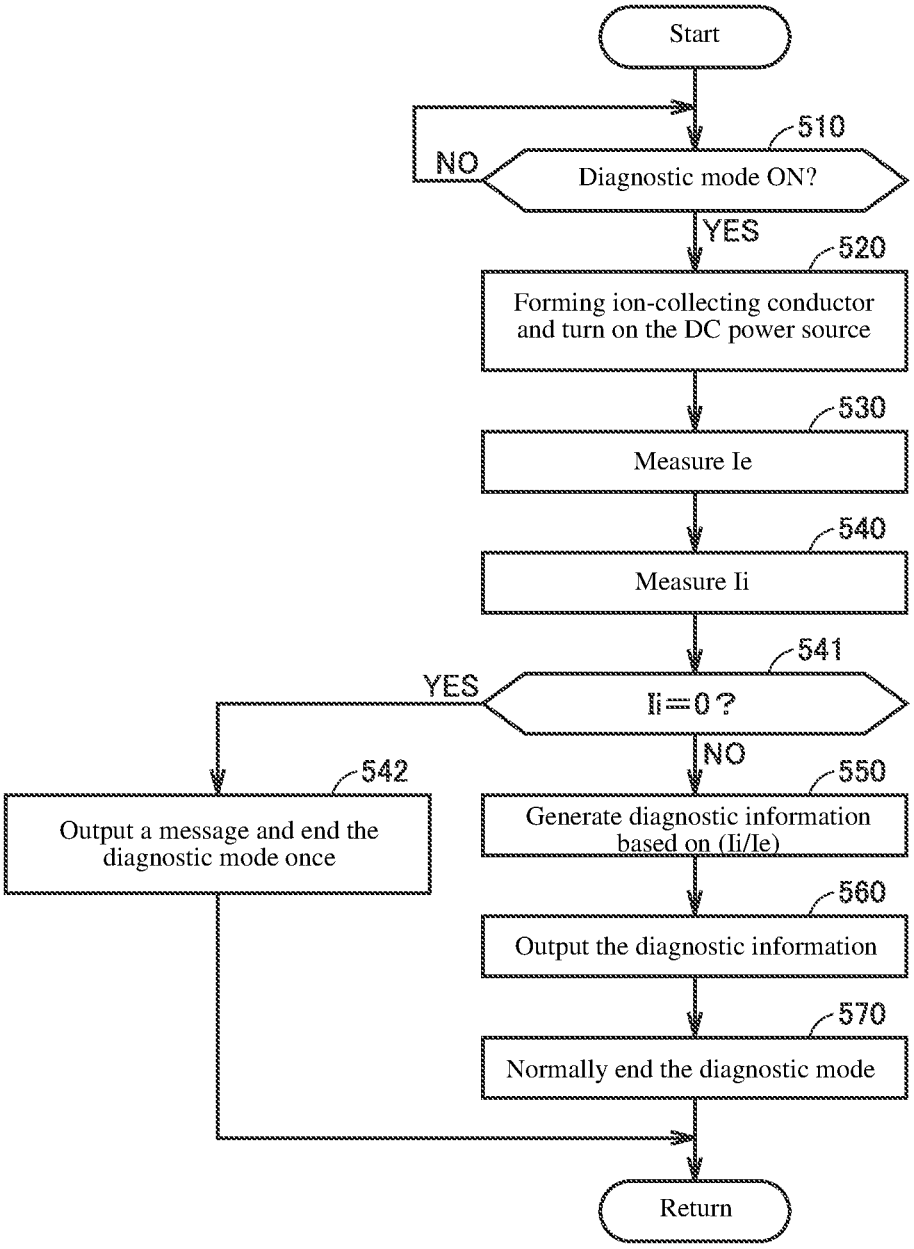
FIG. 6 is a flowchart for explaining control processing in a diagnostic mode of an X-ray generating device according to this embodiment.

FIG. 6 is a flowchart for explaining control processing in a diagnostic mode of the X-ray generating device according to this embodiment. The control processing according to FIG. 6 can be performed, for example, by the control circuit 190.

Referring to FIG. 6, the control circuit 190 determines whether or not the diagnostic mode is turned on by the mode input to the control circuit 190 in Step 510. When the diagnostic mode is turned on (Yes in Step 510), the processing in the diagnostic mode after Step 520 is initiated. On the other hand, when the diagnostic mode is turned off, that is, when it is in the X-ray generation mode (No in Step 510), the processing after Step 520 will not be initiated.

The control circuit 190 operates the DC power supplies 160 and 170 with the fixing member 130 as the "ion-collecting conductor" in Step 520. Thus, as described in FIG. 2, the electron 5 emitted by the energization of the filament 145 by the DC power supply 160 is accelerated by the electric field generated by the output voltage Vdc of the DC power supply 170. Then, a positive ion 9 generated by the collision of the electron 5 against a gas molecule 7 is attracted to the ion-collecting conductor, thereby generating the ion current Ii.

The control circuit 190 measures the emitter current Ie from the detection value of the current sensor 180 in Step 530 under the state of Step 520. The control circuit 190 measures the ion current Ii from the detection value of the current sensor 210 in Step 540. Note that Step 530 and Step 540 may be executed in the reverse order or may be executed simultaneously.

As described above, in a case where the fixing member 130 as the ion-collecting conductor or the housing 110 electrically connected to the fixing member 130 is grounded by a path not including the current sensor 210, in Step 540, the measurement value of the ion current Ii becomes zero (0). Accordingly, Step 541 for comparing the measurement value of the ion current Ii in Step 540 with the determination value c is further performed together with Step 540.

When it is determined that $Ii<\varepsilon$, i.e., $Ii=0$ (YES in Step 541), preferably, in Step 542, a message prompting the confirmation of the states of the housing 110 and the fixing member 130 is output, and the processing of the diagnostic mode is once terminated. Specifically, a message prompting to confirm that the housing 110 or the fixing member 130 (ion-collecting conductor) is not electrically connected to a member other than the current sensor 210 is output, and the processing of the diagnostic mode is once terminated.

On the other hand, when the ion current Ii could be measured in Step 540 (NO in Step 541), the control circuit 190 generates diagnostic information based on the current ratio Ii/Ie (Step 550). As the diagnostic information, the information based on the relation between the pressure estimation value from the current ratio Ii/Ie and the threshold Pth (FIG. 5) or the information based on the relation between the current ratio Ii/Ie and the threshold Jth (FIG. 5) can be used.

The control circuit 190 outputs diagnostic information generated in Step 550 (Step 560) and normally terminates the diagnostic mode (Step 570). The output manner in Step 560 is not particularly limited. For example, the diagnostic information may be output in a manner using visible letters, numbers, illustrations, etc., on a certain display (not shown). Alternatively, the diagnostic information may be output by lighting and non-lighting of a lamp, such as, e.g., a light-emitting diode (LED). Alternatively, the diagnostic information may be output in such a manner that it is transmitted to the server of the service center via the Internet or the like.

As described above, according to the X-ray generating device of this embodiment, the deterioration of the degree of vacuum can be diagnosed based on the current ratio Ii/Ie of the ion current Ii and the emitter current Ie. Note that the degree of vacuum of the X-ray tube 120 depends on the number of gas molecules 7 present in the internal space of the X-ray tube 120. By the ion current Ii, in the same manner as the measured current of Patent Document 2, it is possible to quantitatively detect the amount of positive ions 9 generated by the collision of the gas molecule 7 against the electron 5. However, the amount of positive ions depends not only on the number of gas molecules 7 present in the internal space of the X-ray tube 120 but also on the electron emission amount from the filament 145.

Therefore, the current ratio Ii/Ie of the emitter current Ie to the ion current Ii that depends on the electron emissions from the filament 145 is used. This makes it possible to diagnose the number of gas molecules 7 present in the internal space of the X-ray tube 120, i.e., the degree of vacuum, with higher accuracy than the diagnosis by the ion current Ii alone.

Further, in the X-ray generating device 100, without changing the connection relation between the DC power supply 160, the DC power supply 170, the cathode 140, and the anode 150 from the X-ray generation mode, the housing 110 and the fixing member 130 can be made to act as the "ion-collecting conductor". That is, no arrangement of a mechanism for switching the applying voltage to the cathode 140 and the anode 150 between the X-ray generation mode and the diagnostic mode is required. Thus, the diagnostics of the degree of vacuum can be performed with a simpler configuration than that of Patent Document 2.

Furthermore, in the X-ray generating device 100 according to this embodiment 1, the output voltage Vdc of the DC power supply 170 is preferably switched between the X-ray generation mode and the diagnostic mode.

Figure 7:
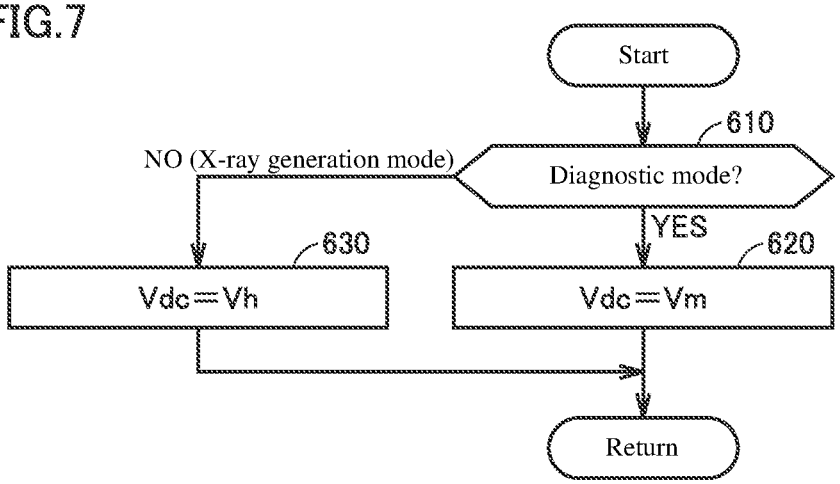
FIG. 7 is a flowchart showing control processing of a DC power supply of an X-ray generating device according to this embodiment.

FIG. 7 is a flowchart for explaining the control processing of the DC power supply 170 in the X-ray generating device 100 according to this embodiment. The control processing shown in FIG. 7 can be performed by the control circuit 190.

Referring to FIG. 7, the control circuit 190 determines in Step 610 whether or not it is in a diagnostic mode. When not in the diagnostic mode, i.e., when it is in the X-ray generation mode (NO in Step 610), it is set to the output voltage Vdc=Vh of the DC power supply 170 in Step 630. Vh is approximately equal to the output voltage Vdc at the X-ray generating device 100# according to Comparative Example, and is about several tens kV to several hundred kV.

On the other hand, when it is in the diagnostic mode (YES in Step 610), the control circuit 190 sets the output voltage of the DC power supply 170 to Vdc=Vm in Step 620. Vm is a voltage lower than Vh in the X-ray generation mode, and may be set to, for example, about 100 V. The discharging inside the X-ray tube 120 is likely to occur due to high voltage application. Therefore, by lowering the output voltage Vdc, the diagnostic mode can be stably performed by preventing the occurrence of discharges at the time of the diagnostic. Further, the generation of unnecessary X-rays can be suppressed.

The control of the output voltage Vdc shown in FIG. 7 can be realized in the following manner. That is, the DC power supply 170 is configured by a power converter having a function of changing the output voltage. To the DC power supply 170 from the control circuit 190, a signal for switching the command value of the output voltage Vdc or a command value of the output voltage Vdc is given.

Note that in this embodiment, the internal structure of the X-ray tube 120 is one example. The diagnostics of the degree of vacuum according to this embodiment based on the measurement value of the current ratio of the ion current Ii to the emitter current Ie can be applied to the X-ray tube of any structure having a cathode provided with a filament for emitting electrons and an anode for generating X-rays by irradiation of electrons.

In this embodiment, the configuration of the X-ray generating device 100 having a built-in diagnostic function of the degree of vacuum has been described. However, the current sensor 210 and the control circuit 190 may be configured as a single unit "diagnostic device". For example, a diagnostic device integrally housing the current sensor 210 and the control circuit 190 within the housing is attached to the fixing member 130 from which the external device 500 is removed, or a housing 110 electrically connected to the fixing member. This allows the path 200 shown in FIG. 2 to be configured to be formed with respect to the fixing member 130. In this case, in the diagnostic mode, the control circuit 190 acquires the measurement value of the emitter current Ie by the current sensor 180 of the X-ray generating device 100 and calculates the current ratio Ii/Ie of the ion current Ii by the current sensor 210 on the diagnostic device to the emitter current Ie. This allows the control circuit 190 to generate the diagnostic information.

Finally, the X-ray generating device disclosed in this embodiment, its diagnostic device, and the diagnostic method are summarized.

The first aspect of the present disclosure relates to the X-ray generating device 100. The X-ray generating device is provided with the X-ray tube 120, the first DC power supply 160, the second DC power supply 170, the first current sensor 210, the second current sensor 180, and the control circuit 190. The X-ray tube is provided with the cathode 140 and the anode 150 sealed inside the vacuum envelope 121, and the ion-collecting conductor 130 attached to the vacuum envelope 121 so as to be in contact with the internal space of the vacuum envelope. The cathode has an electron source 145 for emitting electrons. The anode is arranged to face the cathode and is configured to emit X-rays when the electrons emitted from the electron source are incident. The first DC power supply applies a first DC voltage Vf for supplying the emission energy of electrons to the electron source. The second DC power supply applies the second DC voltage Vdc for generating the electric field for making the anode to be a high potential between the cathode and the anode. The first current sensor measures the value of the first current Ii flowing between the ion-collecting conductor 130 and the node Ng for supplying the potential for attracting positive ions in the vacuum envelope. The second current sensor measures the value of the second current Ie flowing between the anode and the cathode. The control circuit generates the diagnostic information on the degree of vacuum of the X-ray tube based on the current ratio Ii/Ie of value of the first current measured by the first current sensor to the value of the second current measured by the second current sensor, in a state in which the first and second DC voltages are being applied.

According to the above-described first aspect of the present disclosure, the current ratio of the value of the first current that depends on the amount of positive ions generated by the collision of the gas molecule against the electron inside the X-ray tube (vacuum envelope) to the value of the second current that depends on the electron emission quantity is used. This makes it possible for the X-ray generating device to have the function of diagnosing the number of gas molecules present in the internal space of the X-ray tube, i.e., the degree of vacuum, with higher accuracy than the diagnosis by the value of the first current alone.

In the embodiment according to the first aspect of the present disclosure, the control circuit 190 is provided with the storage unit 192. The storage unit stores predetermined information indicating the correspondence relation 310 between the current ratio Ii/Ie and the pressure inside the vacuum envelope in the X-ray tube 120. The diagnostic information is generated using the pressure estimation value calculated using the current ratio by the measurement value of the first and second current sensors 180 and 210 and the correspondence relation.

With such a configuration, it is possible to improve the user convenience by providing the diagnostic information capable of easily imaging the deterioration of the degree of vacuum by converting the degree of vacuum to the pressure that is a physical quantity directly related to the generation of discharges in the X-ray tube.

In the embodiment according to the first aspect of the present disclosure, the X-ray tube 120 is further provided with the X-ray irradiation window 135 and the fixing member 130. The X-ray irradiation window is arranged at the opening of the vacuum envelope 121 and is made of a material that has airtightness and transmits X-rays. The fixing member fixes the X-ray irradiation window to the vacuum envelope while maintaining the sealability of the vacuum envelope. The ion-collecting conductor is configured by the fixing member.

With such a configuration, it is possible to configure the "ion-collecting conductor" for diagnosing the degree of vacuum without adding a new member (hardware).

Further, in embodiment according to the first aspect of the present disclosure, the operation mode of the X-ray generating device 100 has a first mode for outputting X-rays and a second mode for diagnosing the degree of vacuum by generating diagnostic information. The second DC voltage Vdc in the second mode is controlled to be lower than the second DC voltage in the first mode.

With such a configuration, the occurrence of discharges can be prevented, and the degree of vacuum can be stably diagnosed. Further, the generation of unwanted X-rays can be suppressed.

The second aspect of the present invention relates to the diagnostic device of the X-ray generating device 100 equipped with the X-ray tube 120. The X-ray tube 120 is provided with the anode 150 and the cathode 140 with the electron source 145, which are sealed inside the vacuum envelope 121, and the ion-collecting conductor 130 attached to the vacuum envelope so as to be in contact with the internal space of the vacuum envelope. The diagnostic device is provided with the current sensor 210 and the control circuit 190. The current sensor measures the value of the first current Ii flowing between the ion-collecting conductor 130 and the node Ng for applying the potential for attracting positive ions in the vacuum envelope. The control circuit 190 generates the diagnosis information on the degree of vacuum of the X-ray tube in the following manner in a state in which the first DC voltage Vf for supplying the emission energy of electrons is applied to the electron source and the second DC voltage Vdc for generating an electric field for making the anode to be high potential is applied between the cathode and the anode. That is, the control circuit 190 acquires the measurement value of the value of the second current Ie flowing between the anode and the cathode of the X-ray tube from the X-ray generating device. Then, the control circuit 190 generates the diagnostic information on the degree of vacuum of the X-ray tube based on the current ratio of the value of the first current measured by the current sensor to the value of the second current.

According to the above-described second aspect of the present disclosure, the degree of vacuum can be diagnosed with higher accuracy than the diagnosis by the first current value alone by the diagnostic device attached to the X-ray generating device. That is, the diagnosis uses the current ratio of the value of the first current that depends on the anode ion amount generated by the collision of the gas molecule against the electron inside the X-ray tube (vacuum envelope) to the value of the second current that depends on the electron emission quantity from the electron source. This makes it possible to diagnose the number of gas molecules present in the internal space of the X-ray tube, i.e., the degree of vacuum, more accurately than the diagnosis by the first current value alone.

A third aspect of the present invention relates to a diagnostic method of the X-ray generating device 100 equipped with the X-ray tube 120. The X-ray tube 120 is provided with the anode 150 and the cathode 140 with the electron source 145, which are sealed inside the vacuum envelope 121, and the ion-collecting conductor 130 attached to the vacuum envelope so as to be in contact with the internal space of the vacuum envelope. The diagnostic method includes the following steps. That is, the method includes Step 520 for applying the first DC voltage Vf for supplying emission energy of electrons to the electron source and applying the second DC voltage Vdc for generating the electric field for making the anode to be high potential between the cathode and the anode. The method further includes Step 540 for measuring the value of the first current Ii flowing between the ion-collecting conductor 130 and the node Ng for applying the potential for attracting positive ions in the vacuum envelope under the condition in which the first and second DC voltages are being applied. The method further includes Step 530 for measuring the value of the second current Ie flowing between the anode and the cathode of the X-ray tube under the condition in which the first and second DC voltages are being applied. The method further includes Step 550 for generating the diagnostic information on the degree of vacuum of the X-ray tube based on the current ratio of the measured first current value to the measured second current value.

According to the third aspect of the present disclosure, the X-ray generating device uses the current ratio of the value of the first current that depends on the amount of positive ions generated by the collisions of gas molecules against the electrons inside the X-ray tube (vacuum envelope) to the value of the second current that depends on the electron emission quantity from the electron source. This makes it possible to diagnose the number of gas molecules present in the internal space of the X-ray tube, i.e., the degree of vacuum, more accurately than the diagnosis by the first current value alone.

The embodiments disclosed herein are to be considered in all respects as illustrative and not restrictive. The scope of the present invention is indicated by claims rather than by the foregoing descriptions, and is intended to include all modifications within the meanings and scope equivalent to the claims.

DESCRIPTION OF SYMBOLS

5: Electron
7: Gas molecule
9: Positive ion
100, 100♯: X-ray generating device
110: Housing
115: Insulation oil
120: X-ray tube
121: Vacuum envelope
123: Opening
130: Fixing member
135: X-ray irradiation window
140: Cathode
145: Filament
150: Anode
155: Target
160, 170: DC power supply
180: Current sensor (emitter current)
190: Control circuit
191: CPU
192: Memory
193: I/O circuit
194: Electronic circuit
195: Bus
200: Path
210: Current sensor (ion current)
300: Diagnostic area
301 to 304: Paschen curve
310: Characteristic line (current ratio-pressure)
500: External device
Ie: Emitter current
Ii: Ion current
Jth, Pth: Threshold
Ng: Ground node
P: Pressure
Px: Discharge pressure
Vdc, Vf: Output voltage (DC power supply)

The invention claimed is:

1. An X-ray generating device comprising:

an X-ray tube including a cathode, an anode, and an ion-collecting conductor, the cathode and the anode being sealed inside a vacuum envelope, the ion-collecting conductor being attached to the vacuum envelope so as to be in contact with an internal space of the vacuum envelope, the cathode including an electron source for emitting electrons, the anode being arranged to face the cathode and configured to emit X-rays when the electrons emitted from the electron source are incident;

a first DC power supply configured to apply a first DC voltage for supplying emission energy of the electrons to the electron source;

a second DC power supply configured to apply a second DC voltage for generating an electric field for making the anode to be high potential between the cathode and the anode;

a first current sensor configured to measure a value of a first current flowing between the ion-collecting conductor and a node for supplying potential for attracting positive ions in the vacuum envelope;

a second current sensor configured to measure a value of a second current flowing between the anode and the cathode; and a control circuit configured to generate diagnostic information on a degree of vacuum of the X-ray tube based on a current ratio of the value of the first current measured by the first current sensor to the value of the second current measured by the second current sensor in a state in which the first DC voltage and the second DC voltage are being applied, wherein the control circuit includes a storage unit for storing information indicating a predetermined correspondence relation between the current ratio and pressure inside the vacuum envelope in the X-ray tube, wherein the diagnostic information is venerated using a pressure estimation value calculated using the current ratio by measurement values of the first current sensor and the second current sensor and the predetermined correspondence relation, and wherein the pressure estimation value is calculated to be proportional to the $k^{th}$ power of the current ratio, where k is a constant set for each model of the X-ray tubes.

2. The X-ray generating device as recited in claim 1, wherein the X-ray tube further includes:

an X-ray irradiation window arranged at an opening of the vacuum envelope and made of a material that has airtightness and transmits the X-rays; and a fixing member configured to maintain sealability by the vacuum envelope and fixedly hold the X-ray irradiation window to the vacuum envelope, and wherein the ion-collecting conductor is configured by the fixing member.

3. The X-ray generating device as recited in claim 1, wherein an operation mode of the X-ray generating device includes a first mode for outputting the X-rays and a second mode for diagnosing the degree of vacuum by generating the diagnostic information, and wherein the second DC voltage in the second mode is controlled to a voltage lower than the second DC voltage in the first mode.

4. A diagnostic device for an X-ray generating device, the X-ray generating device comprising an X-ray tube including an anode and a cathode provided with an electron source, the anode and the cathode being sealed inside a vacuum-envelope, and an ion-collecting conductor attached to the vacuum envelope so as to be in contact with an internal space of the vacuum envelope, the diagnostic device comprising:

a current sensor configured to measure a value of a first current flowing between the ion-collecting conductor and a node for applying potential for attracting positive ions in the vacuum envelope; and a control circuit, wherein the control circuit is configured to:

acquire, in the X-ray generating device, in a state in which a first DC voltage for supplying emission energy of electrons is applied to the electron source and a second DC voltage for generating an electric field for making the anode to be high potential is applied between the cathode and the anode, a measurement value of a value of a second current flowing between the anode and the cathode of the X-ray tube from the X-ray generating device; and generate diagnostic information on a degree of vacuum of the X-ray tube based on a current ratio of the value of the first current measured by the current sensor to the acquired value of the second current, wherein the diagnostic information is generated using a pressure estimation value calculated using the current ratio by measurement values of the first current sensor and the second current sensor and a predetermined correspondence relation between the current ratio and pressure nick the vacuum envelope in the X-ray tube, and wherein the pressure estimation s aloe is calculated to be proportional to the $k^{th}$ power of the current ratio, where k is a constant set for each model of the X-ray tubes.

5. A diagnostic method for an X-ray generating device, the X-ray generating device comprising an X-ray tube including an anode and a cathode provided with an electron source, the anode and the cathode being sealed inside a vacuum-envelope, and an ion-collecting conductor attached to the vacuum envelope so as to be in contact with an internal space of the vacuum envelope, the diagnostic method comprising the steps of:

applying a first DC voltage for supplying emission energy of electrons to the electron source and applying a second DC voltage for generating an electric field for making the anode to be high potential between the cathode and the anode;

measuring a value of a first current flowing between the ion-collecting conductor and a node for applying potential for attracting positive ions in the vacuum envelope in a state in which the first DC voltage and the second DC voltage are being applied;

measuring a value of a second current flowing between the anode and the cathode of the X-ray tube in a state in which the first DC voltage and the second DC voltage are being applied; and generating diagnostic information on a degree of vacuum of the X-ray tube based on a current ratio of the first current value measured by the current sensor to the acquired value of the second current, wherein the diagnostic information is generated using a pressure estimation value calculated using the current ratio by measurement values of the first current sensor and the second current sensor and a predetermined correspondence relation between the current ratio and pressure inside the vacuum envelope in the X-ray tube, and wherein the pressure estimation value is calculated to be proportional to the $k^{th}$ power of the current ratio, where k is a constant set for each model of the X-ray tubes.

* * * * *